US009890464B2

(12) United States Patent
Arumugam et al.

(10) Patent No.: US 9,890,464 B2
(45) Date of Patent: Feb. 13, 2018

(54) SOLID ELECTROLYTE/ELECTRODE ASSEMBLY FOR ELECTROCHEMICAL SURFACE FINISHING APPLICATIONS

(71) Applicants: Ganesh Arumugam, Honolulu, HI (US); Ashavani Kumar, Honolulu, HI (US); Vinod Veedu, Houston, TX (US)

(72) Inventors: Ganesh Arumugam, Honolulu, HI (US); Ashavani Kumar, Honolulu, HI (US); Vinod Veedu, Houston, TX (US)

(73) Assignee: Oceanit Laboratories, Inc., Honolulu, HI (US)

( * ) Notice: Subject to any disclaimer, the term of this patent is extended or adjusted under 35 U.S.C. 154(b) by 765 days.

(21) Appl. No.: 13/740,914

(22) Filed: Jan. 14, 2013

(65) Prior Publication Data

US 2014/0224662 A1 Aug. 14, 2014

Related U.S. Application Data

(60) Provisional application No. 61/586,092, filed on Jan. 12, 2012.

(51) Int. Cl.

| | |
|---|---|
| ***C25D 5/06*** | (2006.01) |
| ***C25D 17/12*** | (2006.01) |
| ***C25F 7/00*** | (2006.01) |
| ***C25D 11/00*** | (2006.01) |
| ***C25C 7/00*** | (2006.01) |
| ***C25D 17/00*** | (2006.01) |

(52) U.S. Cl.

CPC ..... *C25D 5/06* (2013.01); *C25C 7/00* (2013.01); *C25D 11/005* (2013.01); *C25D 17/00* (2013.01); *C25D 17/12* (2013.01); *C25F 7/00* (2013.01)

(58) Field of Classification Search

CPC . C25B 9/06; C25B 13/00; C02F 2201/46115; H01M 4/8657; H01M 2008/1293; H01M 2008/1095; H01M 2300/0094; H01M 8/0245; H01M 4/8668; C25C 7/00; C25C 7/02

USPC ..... 205/93, 334; 204/414, 421

See application file for complete search history.

(56) References Cited

U.S. PATENT DOCUMENTS

| | | | | |
|---|---|---|---|---|
| 4,935,110 | A * | 6/1990 | Nishiki | C25B 9/10 204/290.08 |
| 5,051,324 | A * | 9/1991 | Bones | C04B 35/113 429/104 |
| 5,733,434 | A * | 3/1998 | Harada | C02F 1/4618 134/1.3 |
| 6,291,091 | B1 | 9/2001 | Preischl et al. | |
| 2007/0045106 | A1* | 3/2007 | Yang | H01M 12/06 204/291 |
| 2007/0171597 | A1* | 7/2007 | Merker | H01G 9/0036 361/523 |
| 2012/0111719 | A1 | 5/2012 | Kendig et al. | |
| 2012/0222967 | A1* | 9/2012 | Oakes | C25B 1/003 205/637 |

FOREIGN PATENT DOCUMENTS

| | | | |
|---|---|---|---|
| JP | 05148681 | A | 6/1993 |
| JP | 2002367634 | A | 12/2012 |

* cited by examiner

*Primary Examiner* — Zulmariam Mendez

(74) *Attorney, Agent, or Firm* — James Creighton Wray; Meera P. Narasimhan

(57) ABSTRACT

A solid electrolyte is formed by blending a coating chemical with metal ions and fatty acid. Filling molds and drying the material in the molds forms the solid electrolyte. The solid electrolyte is mounted on an electrode and attached to a handle. The solid electrolyte is moved over a surface of a substrate with the handle. DC current is passed between the electrode and substrate and ions are transferred to the wetted substrate from the solid electrolyte.

24 Claims, 3 Drawing Sheets

Steel Coupon

Copper deposited on steel coupon

SOLID ELECTROLYTE/ELECTRODE ASSEMBLY FOR ELECTROCHEMICAL SURFACE FINISHING APPLICATIONS

This application claims the benefit of U.S. Provisional Application No. 61/586,092, filed Jan. 12, 2012, which is hereby incorporated by reference in its entirety as if fully set forth herein.

This invention was made with Government support under Contract N00014-09-C-0177 awarded by the Office of Naval Research (ONR). The Government has certain rights in this invention.

FIELD OF THE INVENTION

This invention relates to electroplating, surface cleaning and surface modification.

BACKGROUND OF THE INVENTION

Brush plating is a portable form of electroplating where in a wand covered with a cloth soaked in the plating solution (copper electrolyte) is moved along the substrate and a potential (6-12 Volts) is applied between the wand and the substrate that needs to be plated. As the wand with the electrolyte solution is moved along the substrate, metal ions (copper) from the plating solution is deposited on to the substrate.

In order to have a continuous coating on the substrate the cloth on the wand has to be completely soaked in the plating solution, which requires feeding the solution directly on to the wand. Brush plating is a labor intensive, cumbersome technique that has been used with very little modification ever since its first application. Brush plating process can benefit significantly from an improved process to reduce man hours. The conventional method of electroplating uses a liquid electrolyte with an anode and a cathode, wherein the metal ion from the electrolyte is deposited on to the cathode. In a portable brush plating process, the electrolyte solution and the metal to be plated will be used as a cathode and a potential will be applied between the cathode and brush plating wand (anode). In order to achieve a uniform metal deposition, the cloth covered brush plating wand must be frequently dipped into the electrolyte or the electrolyte needs to be recirculated via a pump to maintain the ionic conductivity for the plating process. One disadvantage of the prior art process is that the brush plating wand needs to be saturated with electrolyte throughout the entire plating process. The needs for saturation and dipping significantly affect the deposition rate and maneuverability and increases time and expense of the overall brush plating operation.

Needs exist for the improvement of brush plating methods and apparatuses.

SUMMARY OF THE INVENTION

The present invention provides a unique solution for reducing the electrolyte recirculation that can significantly accelerate the brush plating process and reduce man hours involved. In the new approach, Oceanit creates a unique way of packaging the electrolyte and eliminates the need for using a highly corrosive liquid electrolyte and the resultant corrosive waste generated from the prior art process.

This invention provides electrode electrolyte assemblies as well as solid or semisolid composite electrolyte materials as an alternative to traditional liquid based electrolytes, that could be used for standard electrochemical operations such as electroplating, electropolishing, electrowinning, electrochemical etching and anodization. The invention also provides a simple, scalable synthetic route to fabricate a highly moldable, solidified electrolyte for potential use in electrochemical applications especially electroplating, anodization, etching, etc. The invention also provides electrode/electrolyte assemblies which can be used for above mentioned electrochemical application Oceanit has developed a revolutionary approach of packaging ionic and nonionic electrolytes in moldable solid form, making the electrochemical process easily applicable on differently shaped substrates without dipping in or recirculating liquid electrolytes. As a specific example, Oceanit pursued the development of copper electroplating solution packaged in a moldable form that improved the brush plating process by eliminating the need for electrolyte recirculation or dipping of the brush plating wand in the electrolyte solution. By packaging the electrolyte in a solid form, Oceanit has eliminated the need for liquid electrolytes to be used in the brush plating process.

Packaging of commercial electrolytes in a solid form offers improvements for plating, surface modification and finishing applications in heavy machinery, defense, military, automobiles, aerospace, jewelry, art, decoration, hobbies and domestic maintenance activities. Major plating and finishing industries such as SIFCO; automobile industries; heavy machinery manufacturing companies; and manufacturers of large products, vehicles and vessels that cannot be dipped in electrolyte for electroplating will use this invention.

Technical problems are solved by the new unique electrode/electrolyte packaging process because it: improves maneuverability and removes cumbersome work in brush plating, eliminates electrolyte recirculation in the traditional brush plating processes, reduces the liquid waste generated by traditional processes, and improves the efficiency of the plating process by saving time and money.

One of the major limitations that is affecting a portable plating or electrochemical etching process using commercial plating solutions with constant recirculation or soaking is a cumbersome and difficult operation when working on larger objects. Due to the constant replenishing of the electrolyte in a brush plating wand, the entire operation is not easily automatable.

Oceanit has developed an innovative solution to perform brush plating of metals with negligible liquid circulation and with improved efficiency of the brush plating process. Oceanit's innovation provides a conformable electrolyte that can be molded in to any desired shape for hard to reach areas to fill large cracks and crevices and to provide a uniform and smooth surface finish.

Oceanit's invention uses a moldable electrode/electrolyte containing the required metal ion and the ability to perform brush plating operation. Only water, sprayed on to the electrode to maintain the conductivity. The approach of making moldable electrode/electrolyte also significantly improves the ability to perform plating and surface finishes operation even on regions unplatable using the traditional brush plating process.

The invention provides a solid electrolyte having precursor, binder and medium in solid or semisolid form and a tool having the product combined in an electrode/electrolyte assembly for electrochemical treatment of a substrate. The solid electrolyte includes metal salts, nanoparticles, organometallic precursor, polymer or ionic organic compounds. The binder includes polymers polyethylene oxide, polyvinyl pyrolidone, silicones, inorganic binders, silicate, surfactants or cetyltrimethyl ammonium bromide. The medium includes aqueous or non aqueous solvent, ionic liquid or aprotic solvent.

The solid electrolyte is a moldable or conformable solid or semisolid in moldable form. The electrode is a conducting metallic or nonmetallic wire, rods, tube foil, plate, sheet, foam or mesh and further has a DC power connection to the electrode. A handle is connected to the electrode. A DC power connection also is connected to the substrate.

In the invention the solid electrolyte material is an electroplating, electropolishing, electrowinning, electroetching or anodizing electrochemical, and the electrochemical treatment includes electroplating, electropolishing, electrowinning, electrochemical etching or anodization.

The invention provides an ionic or nonionic electrolyte in a moldable solid or semisolid form. The ionic or nonionic electrolyte is a mixture of precursor, binder and medium.

The invention provides a method of forming a solid electrolyte with a mixture of electrochemical material and binder. The method further includes attaching the solid electrolyte to an electrode, applying a DC connector to the electrode and providing a handle on the electrode.

A DC connector is applied to a substrate and the substrate is wetted with solvent. Holding the electrode and solid electrolyte with the handle and moving the solid electrolyte in contact with the wetted surface of the substrate completes the process. The wetting includes spraying a solvent mist on the substrate.

Applying a DC connector to a substrate, holding the electrode and solid electrolyte with the handle and moving the wetted solid electrolyte or the solid electrolyte in contact with the wetted surface of the substrate performs the electromaterial process, transferring precursor from the solid electrolyte to the surface of the substrate.

The precursor is a metal salt, copper chloride, chromium chloride, nickel sulfate, organic compounds, pyridine, pyrrole, aniline, organometallic compounds, trimethylgallium, trimethylindium or trimethylaluminum, as examples. The solid electrolyte precursor and the precursors are transferred from the solid electrolyte to a surface of the substrate by using the handle to move the solid electrolyte over the surface of the substrate when the surface or the electrolyte is slightly wetted with solvent.

Mixing the electrochemical material with fatty acid surfactant and polymer binder in a blender with or without solvent medium, pouring the blended mixture in a mold and drying the mixture forms the solid or semisolid electrolyte form for attachment to the electrode.

Mixing the electrochemical material with fatty acid surfactant and polymer binder in a blender with or without solvent medium, pouring the blended mixture in a mold for chemical or physical crosslinking the mixture, thereby forms the solid or semisolid electrolyte pad.

Mixing the electrochemical material with fatty acid surfactant and polymer binder in a blender with or without solvent medium, pouring the blended mixture in a mold having an electrode and drying the mixture or chemical or physical crosslinking thereby forms the solid or semisolid electrolyte/electrode assembly.

These and further and other objects and features of the invention are apparent in the disclosure, which includes the above and ongoing written specification, with the claims and the drawings.

DETAILED DESCRIPTION OF THE DRAWINGS

The revolutionary approach of the present invention is to perform on demand brush plating with limited use of plating solution thereby minimizing the solution recirculation and also improving the capability to plate even on tightest spots in the ship with minimal effort. The present invention is drawn to a solid electrolyte containing high concentration of metal (copper, chromium, nickel etc.) which can release metal ions upon rubbing and applying electrical potential between electrode and the substrate only when the electrolyte is sufficiently hydrated. It is possible to store sufficient quantities of metal ions in the form of electrolyte and to deliver them to the necessary location as desired during the plating process. The solid electrolyte can be attached to the existing wand and can be covered with the cloth and brush plating, which can be performed similar to existing practices. The use of a solid electrolyte to deliver the metal ions opens up new opportunities for brush plating with minimal chemical handling and easier portability. A novel solid copper electrolyte developed by the present invention can be readily used in place of the existing solution based brush plating with very little modification to the existing hardware. This new technique for copper and other metal brush plating will reduce the maintenance time and associated cost significantly.

A solid copper electrolyte for copper brush plating eliminates plating solution recirculation issues and improves the ability to perform plating even in tight spaces.

Figure 1A:
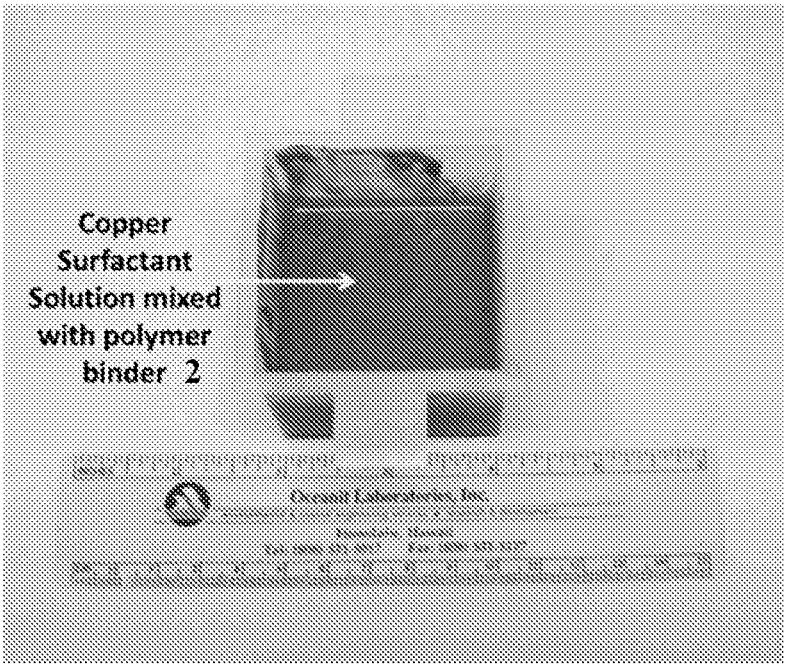
FIG. 1A depicts a photograph of commercial copper surfactant solution—polymer binder 2.
Figure 1B:
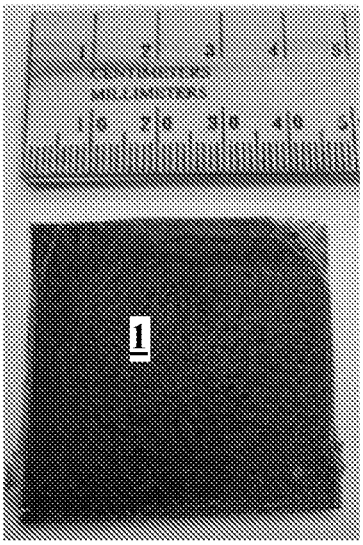
FIG. 1B depicts a photograph of the copper electrolyte 1 fabricated by the present invention.

In one embodiment of the present invention, commercial copper surfactant solution containing nearly 10 wt % of copper octanoate was obtained and used without any purification. In a typical procedure, a known amount of a polymer binder (polyethylene oxide) was mixed using homogenizer with copper octanoate solution in water for 30 mintues. Once the polymer-copper-surfactant solution 2 is homogeneous, the homogenized solution is poured in to plastic 2"×2"×2" cube molds and dried in a vacuum oven at 80° C. for two days. Upon completely drying the solidified electrolyte looks deep blue in color and is shown in FIGS. 1A and 1B.

Figure 2A:
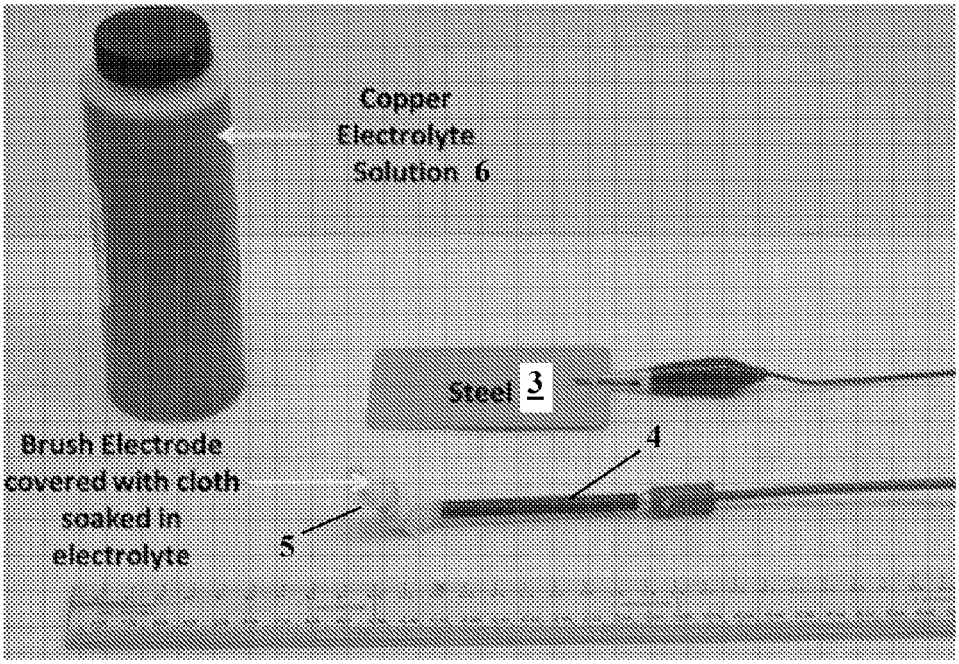
FIG. 2A shows a photograph of copper electrolyte solution 6 based on brush plating set up.
Figure 2B:
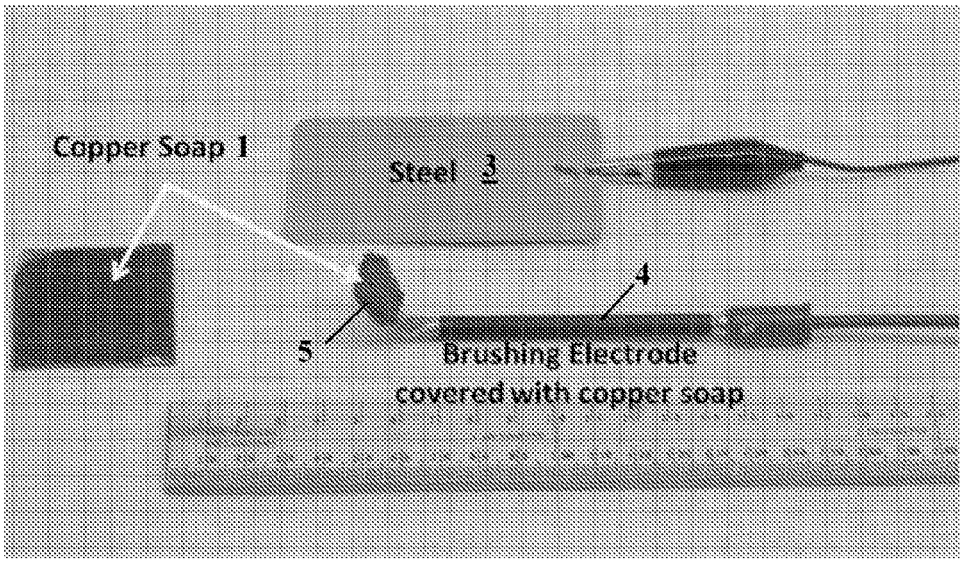
FIG. 2B shows a photograph of copper electrolyte 1 based brush plating set up.
Figure 3A:
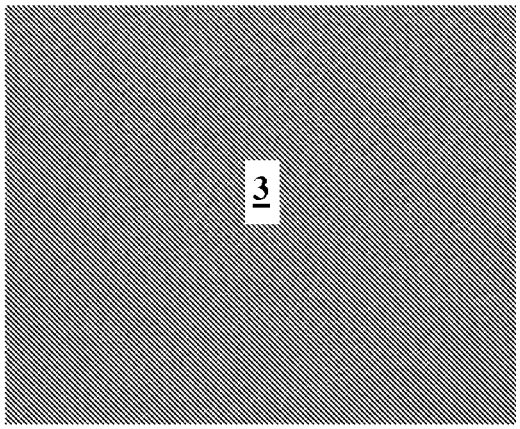
FIG. 3A shows a photograph of steel coupon 3 before copper deposition by brush plating.
Figure 3B:
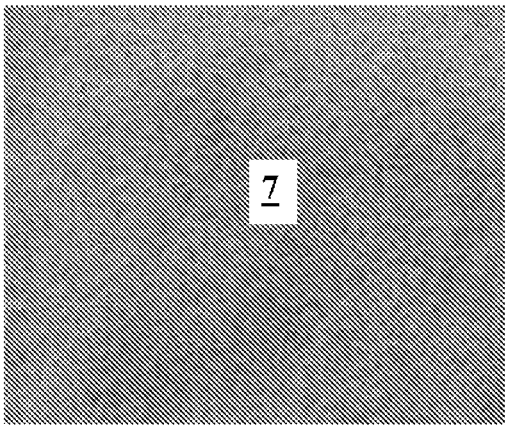
FIG. 3B shows a photograph of steel coupon 3 after copper deposition by brush plating.

The fabricated solid copper electrolyte polymer 1 is used for brush plating copper on steel coupons 3. A DC potential is applied between the steel plate 3 and a copper wand, i.e., brushing electrode 4 covered with the solid copper electrolyte 1 as shown in FIGS. 2A and 2B. The copper electrolyte 1 is hydrated occasionally with few drops (1-2 mL) of water to maintain electrical conductivity. Alternatively, a mist of water is sprayed on the substrate. Copper is deposited on the steel plate 3 by brushing the copper electrolyte 1 over the steel plate 3. The set up used for brush plating with liquid and copper electrolyte is shown in FIGS. 2A and 2B, and the copper deposited steel coupon 7 is shown in FIG. 3.

While the invention has been described with reference to specific embodiments, modifications and variations of the invention may be constructed without departing from the scope of the invention, which is defined in the following claims.

We claim:

1. A product comprising a shaped solid electrolyte electrodeposit material, further comprising a blended mixture of precursor, binder and medium in solid or semisolid form, a substrate to be treated, and an apparatus comprising the product with an electrode/electrolyte assembly adapted for electrochemical treatment of the substrate.

2. The product of claim 1, wherein the solid electrolyte further comprises metal salts, nanoparticles, organometallic precursor, polymer and ionic organic compound.

3. The product of claim 1, wherein the binder further comprises polymers polyethylene oxide, polyvinyl pyrolidone, silicones, inorganic binders, silicate, surfactants or cetyltrimethyl ammonium bromide.

4. The product of claim 1, wherein the medium further comprises aqueous or non aqueous solvent, ionic liquid or aprotic solvent.

5. The product of claim 1, wherein the solid electrolyte is a moldable or conformable solid or semisolid in moldable form.

6. The apparatus of claim 1, wherein the electrode further comprises conducting metallic or nonmetallic wire, rods, tube foil, plate, sheet, foam or mesh and further comprising a DC power connection to the electrode.

7. The apparatus of claim 1, further comprising a DC power connection to the electrode.

8. The apparatus of claim 1, further comprising a handle connected to the electrode.

9. The apparatus of claim 1, further comprising a DC power connection connected to the substrate.

10. The apparatus of claim 1, wherein an electrochemical material is an electroplating, electropolishing, electrowinning, electroetching or anodizing chemical, and wherein the electrochemical treatment comprises electroplating, electropolishing, electrowinning, electrochemical etching or anodization.

11. Apparatus comprising an ionic or nonionic electrolyte in a moldable solid or semisolid form of a blended mixture of electrodeposit material, and further comprising a substrate to be treated with the material.

12. The apparatus of claim 11, wherein the ionic or nonionic electrolyte comprises a mixture of precursor, binder and medium.

13. A method comprising forming a solid electrolyte electrodeposit material blended with a mixture of electrochemical material and binder and electrochemically treating a substrate with the material.

14. The method of claim 13, further comprising attaching the solid electrolyte to an electrode.

15. The method of claim 14, further comprising applying a DC connector to the electrode and providing a handle on the electrode.

16. The method of claim 15, further comprising applying a DC connector to a substrate, wetting the substrate with solvent, holding the electrode and solid electrolyte, and with the handle moving the solid electrolyte in contact with the wetted surface of the substrate.

17. The method of claim 16, wherein the wetting comprises spraying a solvent mist on the substrate.

18. The method of claim 15, further comprising applying a DC connector to a substrate, holding the electrode and solid electrolyte, and with the handle moving the solid electrolyte in contact with the wetted surface of the substrate.

19. The method of claim 18, further comprising transferring precursor from the solid electrolyte to the surface of the substrate.

20. The method of claim 19, wherein the precursor is a metal salt, copper chloride, chromium chloride, nickel sulfate, organic compounds, pyridine, pyrrole, aniline, organometallic compounds, trimethylgallium, trimethylindium or trimethylaluminum.

21. The method of claim 15, wherein the solid electrolyte precursor and the precursors are transferred from the solid electrolyte to a surface of the substrate by using the handle to move the solid electrolyte over the surface of the substrate when the surface is slightly wetted with solvent.

22. The method of claim 13, further comprising mixing the electrochemical material with fatty acid surfactant and polymer binder in a blender with or without solvent medium, pouring the blended mixture in a mold and drying the mixture, thereby forming the solid or semisolid electrolyte form.

23. The method of claim 13, further comprising mixing the electrochemical material with fatty acid surfactant and polymer binder in a blender with or without solvent medium, pouring the blended mixture in a mold and chemical or physical crosslinking the mixture, thereby forming the solid or semisolid electrolyte form.

24. The method of claim 13, further comprising mixing the electrochemical material with fatty acid surfactant and polymer binder in a blender with or without solvent medium, pouring the blended mixture in a mold consisting electrode/substrate and drying the mixture or chemical or physical crosslinking, thereby forming the solid or semisolid electrolyte/electrode assembly.

* * * * *